US006087951A

United States Patent [19]

Ramsden et al.

[11] Patent Number: 6,087,951

[45] Date of Patent: Jul. 11, 2000

[54] MAGNETIC ACCELEROMETER

[75] Inventors: Edward A. Ramsden, Kenosha; Arthur Douglas Guydan, Williams Bay, both of Wis.

[73] Assignee: The Cherry Corporation, Waukegan, Ill.

[21] Appl. No.: 09/286,275

[22] Filed: Apr. 5, 1999

[51] Int. Cl.[7] ..... G08B 21/00

[52] U.S. Cl. ..... 340/669; 324/207.25; 200/61.45 M; 200/61.46; 200/61.53; 73/1.38; 73/1.82; 73/1.86; 73/514.31

[58] Field of Search ..... 340/669 OR; 324/207.25; 200/61.45 M, 61.46, 61.53; 73/1.38, 1.82, 1.86, 514.31

[56] References Cited

U.S. PATENT DOCUMENTS

| | | | |
|---|---|---|---|
| 4,222,250 | 9/1980 | Torita | 68/12 R |
| 4,933,515 | 6/1990 | Behr et al. | 200/61.45 R |
| 5,159,823 | 11/1992 | Fukada et al. | 68/12.21 |
| 5,283,405 | 2/1994 | Green | 200/61.45 R |
| 5,444,531 | 8/1995 | Foreman et al. | 356/341 |
| 5,673,021 | 9/1997 | Woods | 340/547 |
| 5,753,872 | 5/1998 | Komiya et al. | 200/6.45 R |
| 5,841,356 | 11/1998 | Woodruff et al. | 340/635 |

OTHER PUBLICATIONS

D4 Series, Miniature, pp. 3–6 thru 3–11.

*Primary Examiner*—Jeffery A. Hofsass
*Assistant Examiner*—Tai T. Nguyen
*Attorney, Agent, or Firm*—Brinks Hofer Gilson & Lione

[57] ABSTRACT

A magnetic accelerometer detects the sharp lateral rocking movements of an unbalanced spinning tub of a washing machine. The accelerometer has a fixed and a movable magnet that are disposed at a rest position in spaced, magnetic attraction to each other. The movable magnet breaks away from the stationary magnet in response to vibration forces of a predetermined magnitude and frequency. When the magnet breaks away, it presses against an actuator button of a miniature switch and therefore signals an alarm condition. When the vibration forces are reduced below the trigger level, the movable magnet is pulled back to its rest position by magnetic attraction with the stationary magnet. The magnetic attraction of the stationary and movable magnets can be adjusted and the break away point can be set by applying an external magnetic field to the magnets.

37 Claims, 2 Drawing Sheets

MAGNETIC ACCELEROMETER

BACKGROUND OF THE INVENTION

1. Technical Field of the Invention

The invention relates to a magnetic accelerometer and, more particularly, to such an accelerometer that is used to detect excessive vibrations, for example, as occur as a result of an unbalanced load in a washing machine.

2. Description of the Related Art

In electromechanical devices, it is sometimes necessary to sense operational conditions such as undesirable excessive vibrations which could cause a malfunction. For example, washing machines have an internal tub that is designed to spin at very high speeds when loaded with wet clothing. Occasionally, the laundry in the tub may clump together and, therefore, provide an unbalanced load. The unbalanced load can cause the tub to rock back and forth as it rotates. The severe vibrations resulting from this rocking movement can damage the washing machine if they are allowed to continue.

Accordingly, washing machines have been equipped with sensors that detect such undesirable rocking motions or vibrations and either stop the spinning of the tub or signal an unbalanced load. The load can then be redistributed and the spinning cycle can resume.

Electromechanical accelerometers have been used in washing machines to detect an unbalanced load by sensing the sharp accelerations and decelerations of the spinning tub as it rocks back and forth. Accelerometers for this application have typically used a plastic or metal slug that is moved against the return force of a spring in response to the sharp acceleration of the rocking tub. The return force of the spring can be adjusted to accommodate movement of the slug in response to a predefined magnitude and frequency of lateral movements of the tub. Vibrations of sufficient frequency and intensity therefore cause the slug to move along a predetermined path against the force of the return spring until the slug strikes and activates a switch. The activated switch can generate an audible alarm, for example from a buzzer, or a visual alarm, for example from a lighted bulb. When the excessive vibration stops, the slug is automatically returned to its initial rest position by the force of the spring.

Known vibration accelerometers have tended to be relatively expensive and have not allowed a wide range of return force adjustments for the spring. Also, the return spring can lose its resiliency over time and therefore change the amount of lateral vibration force required to trigger an alarm condition. It would, therefore, be desirable to provide an improved, relatively low cost accelerometer that has relatively well-behaved dynamic properties and that defines an alarm trip-point that is readily adjustable over a relatively wide range and is repeatable and predictable over time.

SUMMARY OF THE INVENTION

The magnetic accelerometer of the invention detects sharp lateral movements by breaking a moveable magnet away from a rest position at which it is held by the attraction of a stationary magnet. When the magnitude and frequency of the lateral forces are sufficient to break away the moveable magnet from its rest position adjacent to the stationary magnet, the moveable magnet then impacts and activates a switch actuator and registers an alarm condition. The breakaway force for the moveable magnet can be set by adjusting the magnetic force of attraction between the moving and stationary magnets. The magnetic force remains relatively constant over time and, therefore, the trip-point of the improved magnetic accelerometer is repeatable and predictable over time.

The stationary and moveable magnets are positioned so that, when the activating force is removed or reduced below the trigger level, the moveable magnet will return to its rest position in response to the attractive force of the stationary magnet. The magnetic accelerometer of the invention does not require a return spring and, therefore, it is not subject to malfunction resulting from the failure or loss of resiliency of a spring. The improved magnetic accelerometer also provides a magnetic return force that has a greater range of adjustment than can be provided by a return spring.

DETAILED DESCRIPTION OF THE INVENTION

Figure 1:
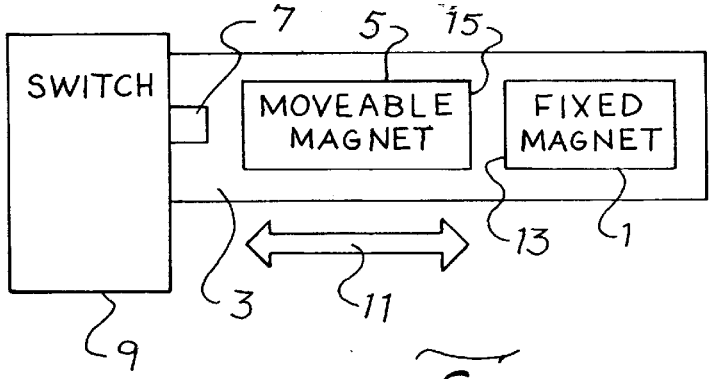
FIG. 1 illustrates a block diagram of the components of a magnetic accelerometer in accordance with the invention.

In the drawings, illustrated elements are not necessarily drawn to scale, and the same reference numbers designate like elements in several views. FIG. 1 shows a block diagram of the components of an improved magnetic accelerometer. The accelerometer has a magnet 1 that is disposed in a fixed position at the end of a raceway 3. A second magnet 5 is mounted in the raceway 3 for lateral back-and-forth movement in the directions of the arrow 11 along the raceway between a rest position adjacent to the fixed magnet 1 and an opposite position wherein it presses an actuating button 7 of a switch 9. As an example, the switch 9 may have normally open switch contacts when the movable magnet 5 is disposed adjacent to the fixed magnet 1 and, when the movable magnet 5 presses the actuating button 7, the switch closes the switch contacts. Alternatively, the switch may have normally closed switch contacts which are opened when the switch is activated.

The magnets 1 and 5 are oriented so that they attract each other. The end 13 of the fixed magnet 1 therefore has a magnetic pole that is opposite the pole of the opposing face 15 of the movable magnet. For example, if the surface 13 of the fixed magnet 1 is a north pole, then the surface 15 of the movable magnet 5 will be a south pole. Likewise, if the surface 13 of the fixed magnet 1 is a south pole, then the surface 15 of the movable magnet 5 will be a north pole. The adjacent faces 13 and 15 of the fixed and movable magnets 1 and 5 therefore attract one another so that the movable magnet 5 is pulled toward the fixed magnet 1 by magnetic attraction.

If the accelerometer of FIG. 1 is at rest, the movable magnet 5 is disposed at its closest rest position with respect to the fixed magnet 1 and therefore does not actuate the button 7 of the switch 9. If the assembly of FIG. 1 is moved rapidly from side-to-side in the directions of the arrow 11, at some intensity and frequency of lateral movement, the movable magnet 5 will break away from the fixed magnet 1 and will slide along the raceway 3 until it presses and activates the button 7 and therefore operates the switch 9. The assembly of FIG. 1 is therefore a magnetic accelerometer that operates a switch to provide an alarm condition when a predetermined level of acceleration force (i.e., the magnitude and/or frequency of the force) is sufficient to break away the moveable magnet from its rest position.

The accelerometer of FIG. 1 may be used, for example, to detect excessive vibrations that result from an unbalanced load in a washing machine (not shown). If the spinning tub of a washing machine has an unbalanced load of laundry, the resulting rocking motion of the tub will cause the accelerometer assembly of FIG. 1 to generate an alarm signal and/or turn off the washer if the force of the rocking motion is sufficient to trigger the switch 9.

Figure 2:
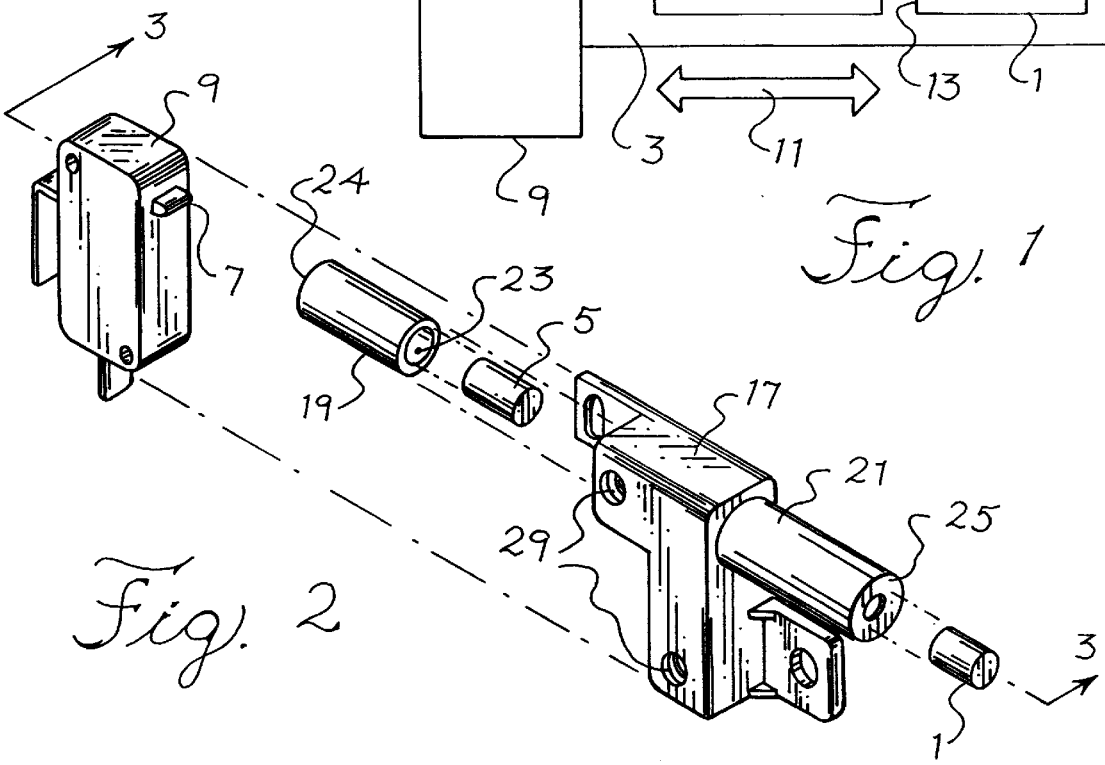
FIG. 2 illustrates an exploded perspective view of components of an embodiment of a magnetic accelerometer.

FIG. 2 illustrates an exploded perspective view of the magnetic accelerometer discussed with respect to FIG. 1. The accelerometer has a housing 17 that receives a cylinder 19 that slides within an internal bore or raceway of a fixed cylinder portion 21 of the housing. The movable cylinder 19 may be made of a non-magnetic material such as plastic or brass. As shown in FIG. 2, an interior area 23 of the cylinder 19 receives the magnet 5. The magnet 5 is pressed into an opening of the cylinder 19 and is held within the cylinder, for example by glue. The magnet 5 therefore moves in the bore or raceway of the cylinder portion 21 of the housing 17 by virtue of the sliding movement of the retaining cylinder 19. The opposite stationary magnet 1 is adhered to the end of the fixed cylinder portion 21, for example by an epoxy potting material. The switch 9 is mounted within the housing 17 so that the end 24 of the retaining cylinder 19 can press against and therefore actuate the button 7.

Figure 3:
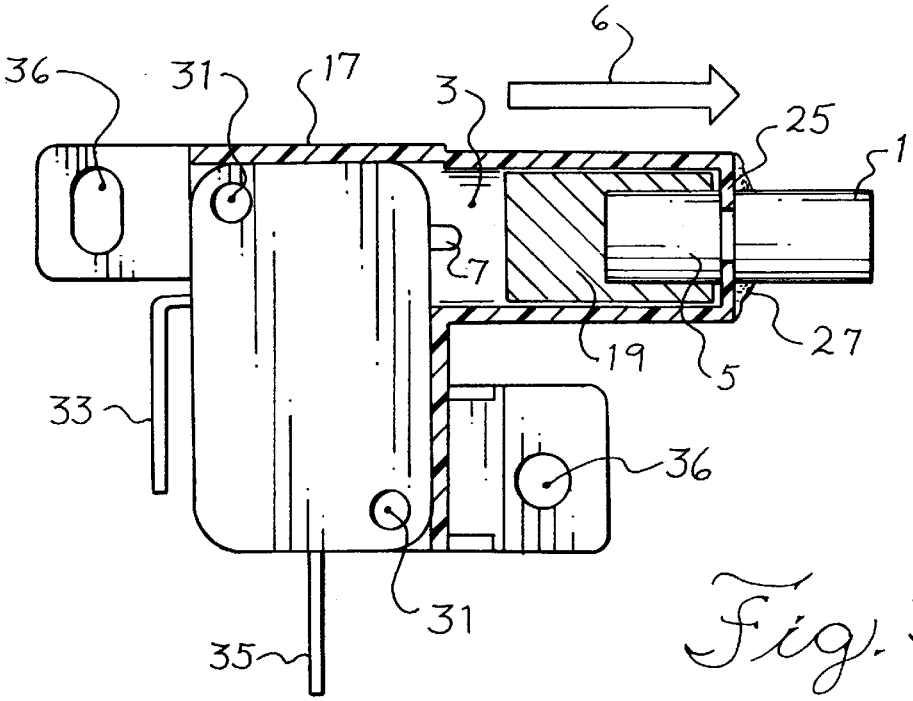
FIG. 3 illustrates a cross-sectional view of the assembled accelerometer of FIG. 2 taken along a line 3—3, with the moveable magnet at its rest position.

FIG. 3 illustrates a cross-sectional view of the assembled switch components of FIG. 2, taken along a section line 3—3. The movable magnet 5 of FIG. 3, having moved in the direction of the arrow 6, is shown in its rest position in association with the stationary magnet 1. While the magnets 1 and 5 could contact each other in this position, in FIG. 3 the magnets are shown held apart by an intervening wall 25 that is formed at the end of the fixed cylinder 21. At present the spaced position of the magnets shown in FIG. 3 is preferred, because the force required to break away contacting magnets might be too great. Also, if the ends of the magnets 5 and 1 contact one another, it is believed that the force required to break apart the magnets might not be as easily adjustable as in the case where the magnets are held in spaced relation.

Figure 4:
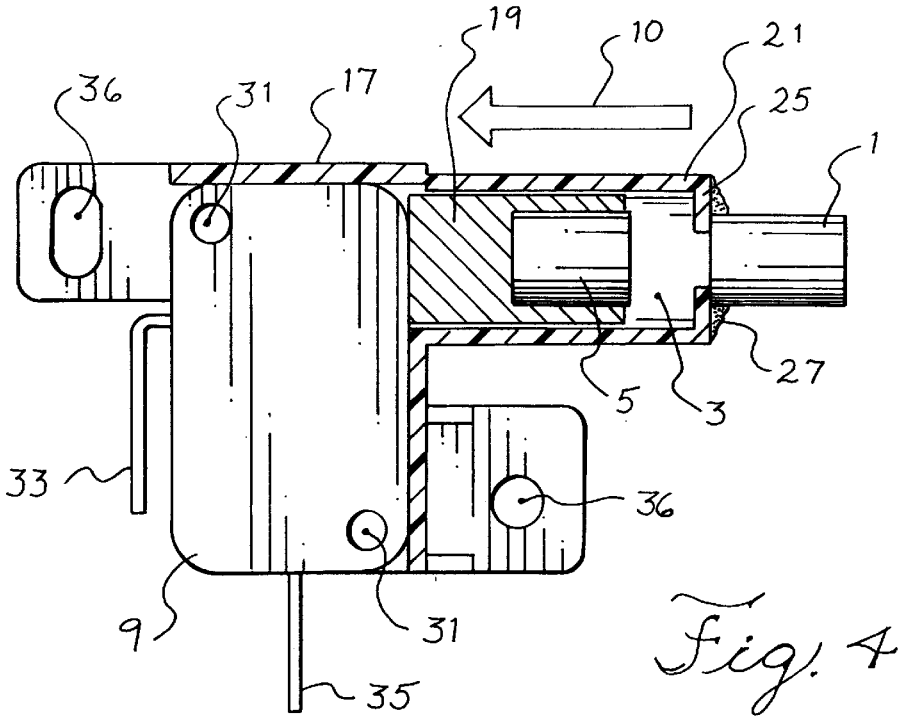
FIG. 4 illustrates a cross-sectional view of the assembled accelerometer of FIG. 2 taken along a line 3—3, with the moveable magnet at its switch actuation position.

FIG. 4 illustrates a cross-sectional view of the accelerometer assembly of FIG. 3 with the movable magnet 5 disposed at its opposite position wherein it is pressed against the button 7 to activate the switch 9. The magnet 5 is moved to this position when the intensity and frequency of vibrations in the direction of the arrow 10 are sufficient to break the magnetic force of attraction that holds the magnet 5 in its rest position.

Although FIGS. 3 and 4 show the stationary magnet 1 adhered to the end of the cylinder 21 with epoxy potting material 27, it is contemplated that the stationary magnet could be held in place in other ways. For example, the stationary magnet 1 could be insert molded to the end of the cylinder portion 21 of the housing 17. In a mass manufacturing environment, insert molding of the fixed magnet 1 may be preferred. Likewise, the magnet 5 could be fixed to a retaining cylinder 19 by means other than glue. For example, the fixed magnet 5 could be die cast into a retaining cylinder that is made of a non-magnetic material such as zinc. Alternatively, the retaining cylinder could be eliminated and the dimensions of the magnet 5 could be increased so that it slides back and forth by itself within the bore of the cylindrical portion 21 of the housing. If a retaining cylinder 19 is used, it could also be made of a magnetic material, for example steel. However, it is believed that a magnetic material such as steel may not be preferred if it makes it difficult to adjust the force of attraction between the magnets 1 and 5 and therefore the break-away force of the magnets.

The material of the housing 17 is selected for shock resistance, wear resistance and lubricity. It is believed that a polycarbonate ABS mix, for example incorporating the polycarbonate Lexan, will have suitable shock and wear resistance and will therefore not disintegrate when exposed to the relatively substantial vibrations of a washing machine over time. This material should also provide a relatively slippery surface in the bore of the cylinder 21 and therefore allow relatively easy sliding of the movable magnet 5 or magnet retaining cylinder 19.

A suitable miniature switch 9 is commercially available from the Cherry Corporation of Waukegan, Ill. As an example, the Model D41L Light Force Miniature switch has been found suitable in operation. This switch has a thermoplastic polyester housing with a button that is actuated in response to a force of about 15 gms. The miniature switch is mounted in the housing 17 by screws or posts that are disposed in aligned holes 29 and 31 of the housing 17 and switch 9. Electrical terminals 33 and 35 connect the switch with a suitable alarm such as a lamp or buzzer. Alternatively, the terminals can be connected to turn off a motor which spins the laundry tub. Other types of devices could be used in place of this switch. For example, magnet sensing devices such as reed switches, hall-effect sensors or magnetoresistors could be used to detect the movement of the moveable magnet from its rest position.

In a washing machine, the rotating tub is supported by a frame that is affixed to an inertial or damping weight (not shown). In operation, the rocking motion of the unbalanced tub is transferred to the supporting frame and inertial weight which tends to damp the vibrations of the tub. The magnetic accelerometer assembly of FIGS. 1–4 may be mounted on the inertial weight so that it responds to vibrations that are transferred from the tub.

In manufacturing the magnetic accelerometer of FIGS. 1–4, it may be necessary to adjust or tune the strength of the magnetic fields of the movable and fixed magnets in order to define a desired force trigger point at which the movable magnet will break away from the fixed magnet and activate the switch 9. The attractive magnetic force between the magnets 1 and 5 must also be sufficient to pull the magnet 5 back to its rest position with respect to the magnet 1 when the intensity and/or frequency of the activation force drops below its trigger level.

The magnetic attractive force between the magnets 1 and 5 is adjusted or tuned by an external magnetic field that induces magnetic fields of desired intensity in the magnets. It has been found that magnets made of, for example Alnico, are suitable for this magnetic field adjustment process. These magnets also tend to hold their adjusted magnetism without significant variation for a considerable time.

Figure 5:
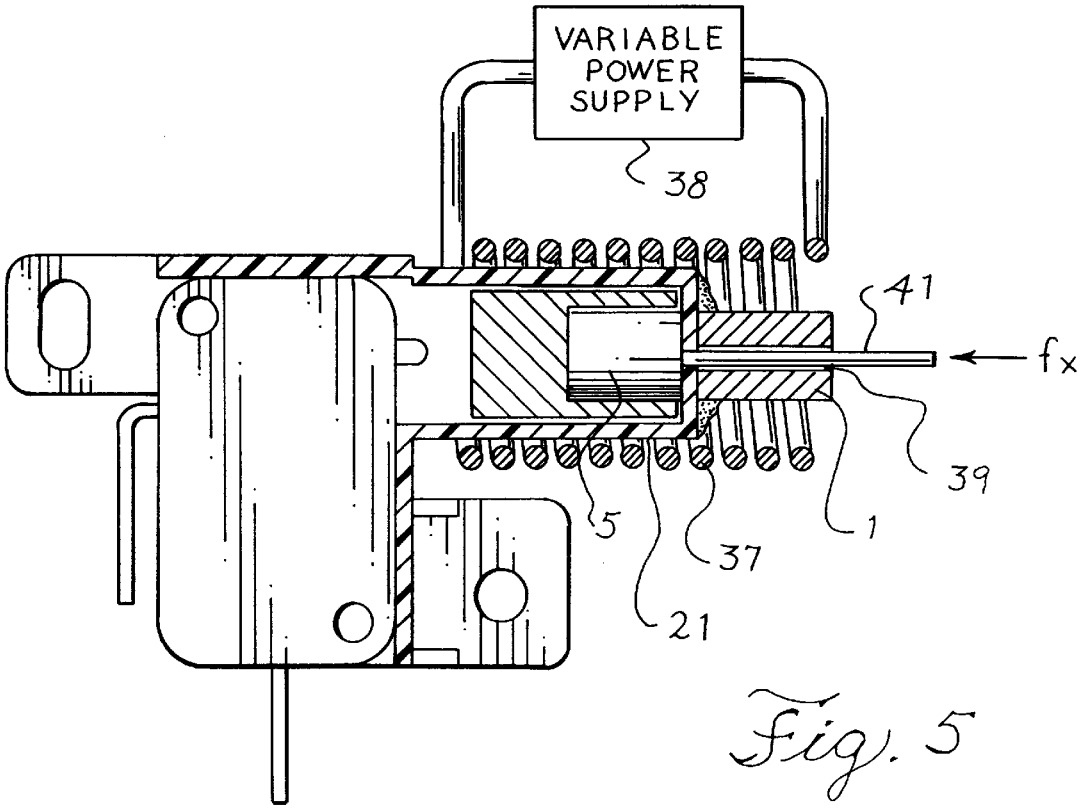
FIG. 5 illustrates a cross-sectional view of the assembled accelerometer of FIG. 2 taken along a line 3—3, and engaged with a magnetic field-inducing coil and a pin that applies a test force to the movable magnet.

With reference to the cross-sectional view of FIG. 5, in manufacturing, a coil of wire 37 is disposed around the fixed cylinder portion 21 of the housing. Electricity is then applied, for example by a variable power supply 38, to energize the coil in a known manner and thereby induce magnetic fields in the magnets 1 and 5.

At present, three methods for tuning or setting the magnetic fields of the magnets are contemplated. In the first method, a magnetic field of known intensity could be applied to induce magnetism in the magnets and define a desired level of trigger force, without requiring further testing and adjustment of the magnetism. Tests are under way to determine if the strength of the induced magnetic fields of the magnets correlates to the force required to break the magnets apart. If there is a strong correlation, it is conceivable that the magnets could be magnetized for desired force break points without requiring break point testing in manufacturing.

As shown in FIG. 5, in a second method of manufacture, a hole 39 is drilled through the fixed magnet 1 and a pin 41 is inserted through the fixed magnet and pressed against the movable magnet 5. An increasing measured force $f_x$ is then applied by the pin until the magnet 5 breaks away from its rest position adjacent to the magnet 1. The break point of the magnets is therefore relatively precisely determined. In manufacturing using this method, an induced magnetic field of maximum intensity is first applied to the magnets 1 and 5 by the coil 37 in order to magnetize them to their greatest extent. The pin 41 is then used to measure the force required to break the magnets apart. If the detected break force is higher than desired, the induced magnetic field is reduced in intensity and the break force is again measured. The induced intensity of the magnetic fields of the magnets is thereafter reduced in steps until the desired break point is detected. This method could be used to determine a correlation between the strength of the induced magnetic fields and the break point of the magnets. If a strong correlation is found, it might not be necessary to test the break point for all accelerometer assemblies in manufacturing. However, if a strong correlation is not found, the pin-implemented method for detecting and adjusting the break point of the magnets might be required for all accelerometers.

A third approach in manufacturing employs a test station that shakes each accelerometer assembly with a predetermined intensity and frequency until the moveable magnet breaks away from its rest position and activates the miniature switch. In operation of such a system, the magnets of each assembly are initially magnetized to their greatest extent and the break point is tested. If the magnetic break point is too high, the induced magnetic field is decreased in steps and testing continues until the desired break point is achieved.

Variations and modifications of the embodiments disclosed herein may be made without departing from the scope and spirit of the invention. For example, an accelerometer could employ only one magnet. In such an accelerometer, the moveable element could be a cylinder of magnetic material such as steel which is attracted by the magnetic force of a stationary magnet. Alternatively, a stationary element made of, for example steel, could be disposed at the end of the bore or raceway of the fixed cylinder 21 and the moveable element could be a magnet which pulls itself to the stationary steel element.

Also, the improved magnetic accelerometer of the invention can be used by itself or in combination with other like accelerometers to detect forces acting in different directions for devices other than washing machines. For example, accelerometers according to the invention could be mounted in different positions within boxes or packages to detect and record excessive forces in shipping. Accelerometers could also be used in automobiles to detect abrupt deceleration forces and deploy airbags or tighten seat belts. The aforementioned description is therefore intended to be illustrative rather than limiting and it should be understood that the following claims and their equivalents set forth the scope of the invention.

We claim:

1. A method for detecting a predetermined level of acceleration force, comprising the steps of:

providing a stationary magnet and a movable magnet with a predetermined magnetic attraction when the movable magnet is disposed at a rest position with respect to the stationary magnet;

accelerating the magnets with a force having a predetermined level sufficient to break the movable magnet away from its rest position; and activating a force indicator after the movable magnet breaks away from its rest position.

2. The method of claim 1, further including the step of returning the movable magnet to its rest position by magnetic attraction with the stationary magnet when the acceleration force is stopped or reduced below said predetermined level.

3. The method of claim 1, further including disposing the stationary and movable magnets in spaced magnetically attracting relation when the movable magnet is in its rest position.

4. The method of claim 1, wherein said step of activating a force indicator includes the step of having the movable magnet actuate an alarm switch when the movable magnet breaks away from its rest position.

5. The method of claim 4, further including the step of activating an audible alarm when said alarm switch is actuated.

6. The method of claim 4, further including the step of activating a visual alarm when said alarm switch is activated.

7. The method of claim 1, further including the step of using the break away of the movable magnet to detect an unacceptable shaking force induced by an unbalanced load in the tub of a washing machine.

8. The method of claim 7, wherein said step of activating a force indicator includes the step of having the movable magnet actuate an audio or visual alarm on the washing machine when the movable magnet breaks away from its rest position.

9. The method of claim 7, wherein said step of activating a force indicator includes the step of having the movable magnet turn off the washing machine when the movable magnet breaks away from its rest position.

10. The method of claim 7, wherein said step of activating a force indicator includes having the movable magnet break away from its rest position and actuate a switch to signal the unbalanced load of the washer or to stop the washer.

11. The method of claim 1, further including the step of adjusting the magnetic attraction of the movable and stationary magnets to a desired level at which a predetermined level of acceleration force can be detected.

12. The method of claim 1, further including the step of adjusting the magnetic attraction between the movable and stationary magnets to detect a predetermined level of acceleration force by:

(a) inducing a maximum magnetic field in said stationary and movable magnets;

(b) determining the force required to break away the movable magnet from its rest position;

(c) if the determined force required to break away the movable magnet is greater than a predetermined level, inducing a reduced magnetic field in said stationary and movable magnets and repeating step (b); and (d) making no further adjustments of the magnetic fields of the magnets if the magnitude of the determined force required to break-away the movable magnet is an acceptable approximation of said predetermined level of acceleration force.

13. The method of claim 12, wherein said step of determining the force includes the step of pushing a pin against the movable magnet and noting the force at which the movable magnet breaks away from its rest position.

14. The method of claim 12, wherein said step of determining the force includes shaking the movable and stationary magnets with increasing intensity and noting the intensity of the shaking force at which the movable magnet breaks away from its rest position.

15. An accelerometer, comprising:

an electrical switch;

a housing having a raceway;

a movable magnet disposed in said raceway; and a fixed magnet disposed in magnetic attractive relation to said movable magnet;

whereby the movable magnet breaks away from a rest position and activates the switch in response to shaking of the housing above a predefined acceleration force trigger level and returns to its rest position when the shaking is stopped or reduced below said predefined trigger level.

16. The accelerometer of claim 15, wherein said movable magnet is disposed at its rest position in spaced relation to said fixed magnet.

17. The accelerometer of claim 16, including means for inducing magnetic fields of varying intensity in said movable and fixed magnets until the attractive force of the magnets defines a break away of the movable magnet from its rest position at a predetermined magnitude of shaking force.

18. The accelerometer of claim 16, including means for testing the amount of force required to break away the movable magnet from its rest position.

19. The accelerometer of claim 18, wherein said means for testing includes a hole drilled through said fixed magnet and a pin for engaging said movable magnet through said hole and applying an increasing measured force to said movable magnet until it breaks away from its rest position.

20. The accelerometer of claim 15, further including means for mounting the accelerometer in a washing machine so that the movement of said movable magnet detects excessive rocking of a laundry tub of the washing machine.

21. An accelerometer comprising:

an alarm switch; and two magnetically attracted elements, one of the elements being stationary and the other element moveable between a rest position adjacent to the stationary element and an opposite position in contact with and activating said alarm switch.

22. The accelerometer of claim 21, wherein at least one of said elements is a magnet.

23. The accelerometer of claim 21, wherein at least one of said elements is a magnet capable of being magnetized to a desired magnetic strength in response to an induced magnetic field.

24. The accelerometer of claim 21, wherein at least one of said elements is an Alnico magnet.

25. The accelerometer of claim 21, wherein the elements are in contact in said rest position.

26. The accelerometer of claim 21, including means for holding the elements in spaced relation in said rest position.

27. The accelerometer of claim 21, wherein each of said elements is a magnet.

28. The accelerometer of claim 21, wherein each of said elements is an Alnico magnet.

29. The accelerometer of claim 21, wherein said moveable element breaks away from said rest position in response to a predetermined level of force.

30. The accelerometer of claim 21, wherein said moveable element breaks away from said rest position and actuates said alarm switch in response to a predetermined level of force.

31. The accelerometer of claim 21, wherein said moveable element breaks away from said rest position and actuates said alarm switch in response to a predetermined level of force and returns to said rest position in response to magnetic attraction when said force is removed or reduced below said predetermined level.

32. The accelerometer of claim 21, including test means for applying acceleration force to said moveable element and determining the magnitude of force required to break the moveable element away from its rest position.

33. The accelerometer of claim 32, wherein said test means includes an opening through said stationary element and a probe for engaging said moveable element through said opening and applying said acceleration force.

34. The accelerometer of claim 32, wherein said test means includes means for applying adjustable levels of shaking force to said moveable element and determining the level of shaking force required to break the moveable element from its rest position.

35. The accelerometer of claim 21, including magnetizing means for inducing a magnetic field of predetermined strength in at least one of said elements so that the moveable element will break away from its rest position and activate said alarm switch in response to a corresponding level of acceleration force.

36. The accelerometer of claim 35, wherein said magnetizing means includes an electrically conductive coil disposed adjacent to said elements when the stationary element is in said rest position, said coil inducing a magnetic field of predetermined magnitude in at least one of said elements in response to energizing electrical energy.

37. The accelerometer of claim 21, wherein one of said elements is a magnet and the other of said elements is made of a material that is attracted to the magnet.

* * * * *

UNITED STATES PATENT AND TRADEMARK OFFICE

CERTIFICATE OF CORRECTION

PATENT NO. : 6,087,951
DATED : July 11, 2000
INVENTOR(S) : Edward A. Ramsden et al.

It is certified that error appears in the above-identified patent and that said Letters Patent is hereby corrected as shown below:

Title page,
Column 1,
Line 4, under "U.S. PATENT DOCUMENTS", change "5,283,405" to -- 5,283,402 --.

Signed and Sealed this

Twenty-seventh Day of November, 2001

*Attest:*

Nicholas P. Godici

NICHOLAS P. GODICI